US006394515B1

(12) United States Patent
Keleher et al.

(10) Patent No.: US 6,394,515 B1
(45) Date of Patent: May 28, 2002

(54) GOLFING AID

(76) Inventors: Wayne Anthony Keleher; William Robert Warwick-Day, both of 23 Park Street, North Rockhampton Qld 4701 (AU)

( * ) Notice: Subject to any disclaimer, the term of this patent is extended or adjusted under 35 U.S.C. 154(b) by 0 days.

(21) Appl. No.: 09/622,893

(22) PCT Filed: Mar. 2, 1999

(86) PCT No.: PCT/AU99/00116

§ 371 (c)(1),
(2), (4) Date: Aug. 30, 2000

(87) PCT Pub. No.: WO99/44695

PCT Pub. Date: Sep. 10, 1999

(30) Foreign Application Priority Data

Mar. 5, 1998 (AU) ..... 57366/98

(51) Int. Cl.[7] ..... A63B 47/00; A63B 57/00
(52) U.S. Cl. ..... 294/19.2; 294/115; 473/386
(58) Field of Search ..... 294/19.1, 19.2, 294/24, 115; 473/132, 286, 386

(56) References Cited

U.S. PATENT DOCUMENTS 683,244 A * 9/1901 Boda et al. ..... 473/132
2,834,629 A * 5/1958 Williams ..... 294/19.2
2,943,856 A * 7/1960 Eimerman ..... 294/19.2
3,904,200 A * 9/1975 Jackle et al. ..... 294/19.2
4,013,295 A * 3/1977 Baughman ..... 294/19.2
4,529,369 A 7/1985 Phelps
4,616,826 A * 10/1986 Trefts ..... 294/19.2
4,714,250 A * 12/1987 Henthorn ..... 294/19.2
4,819,938 A 4/1989 Hill
4,949,961 A * 8/1990 Milano ..... 294/19.2
4,969,646 A * 11/1990 Tobias ..... 294/19.2
5,004,240 A 4/1991 Tsukamoto
5,165,744 A 11/1992 Vogrin
5,184,859 A 2/1993 Nibra et al.
5,310,177 A 5/1994 Conrad et al.
5,330,177 A 7/1994 Rogge
5,503,394 A * 4/1996 Mauck et al. ..... 473/386
5,669,646 A 9/1997 Flocca et al.
5,672,121 A 9/1997 Miller
5,707,303 A * 1/1998 Berkowitz et al. ..... 294/19.2

FOREIGN PATENT DOCUMENTS

GB 2 294 404 A 1/1996

* cited by examiner

*Primary Examiner*—Dean J. Kramer
(74) *Attorney, Agent, or Firm*—Hoffman, Wasson & Gitler

(57) ABSTRACT

A golfing aid which holds a golf ball and a tee together for insertion into the ground. The golfing aid has an elongated body portion with a lower end. A golf ball positioning member can hold the top and/or sides of a golf ball. A releaseable golf ball gripper holds the golf ball against the positioning member and a releaseable golf tee gripper holds the golf ball and tee together.

8 Claims, 5 Drawing Sheets

GOLFING AID

This application is a 371 of PCT/AU99/00116, filed Mar. 2, 1999.

FIELD OF THE INVENTION

This invention relates to a golfing aid which can pick up and hold golf balls without requiring the golfer to bend over to pick up the golf ball. The invention is also directed to a golfing aid which can hold a golf ball and tee in position such that the golfer can insert the tee into the ground with the golf ball positioned on the tee. Various other features of the golfing aid will become apparent in the specification.

BACKGROUND ART

There is a need to provide a golfing aid which can allow a golf ball to be picked up from a ground surface or placed on a ground surface without the golfer needing to bend over or bend knees. This is particularly the case with older golfers who may suffer from arthritic problems or weakness of the leg muscles. Pregnant women also find it difficult to bend to pick up or place golf balls.

Similarly, there is a need to provide a golfing aid which allows the golf ball to be placed on the golf tee without the golfer being required to bend over or bend knees.

There is also a requirement to provide a golfing aid which can ensure that the golf tee is at the correct height above the ground, without the golfer having to bend over or bend knees.

Presently, there appears to be no commercially available golfing aid which can pick up or place a golf ball or hold a golf ball and tee together such that the tee can be inserted into the ground with the golf ball already positioned on it, or where the tee can be inserted to the correct height above the ground surface.

SUMMARY OF THE INVENTION

The present invention is directed to a golfing aid which is able to overcome at least one of the abovementioned disadvantages or provide the public with a useful or commercial choice.

In one form, the invention resides in a golfing aid which can hold a golf ball and tee together for insertion into the ground, the golfing aid having an elongate body portion having a lower end which has:

- a golf ball positioning member which can hold the top and/or sides of the golf ball;
- a releasable golf ball gripping means which holds the golf ball against the positioning member, and which can be released to release the golf ball; and
- a releasable golf tee gripping means which holds the golf ball and tee together.

In another form, the invention resides in a golfing aid which can pick up a golf ball from the ground or place a golf ball on to the ground, the golfing aid having an elongate body portion having a lower end which has:

- a golf ball positioning member which can hold the top and/or sides of the golf ball; and
- a releasable golf ball gripping means which holds the golf ball against the positioning member, and which can be released to release the golf ball.

In another form, the invention resides in a golfing aid which can pick up a golf ball from the ground and/or position a golf ball relative to the ground, the golfing aid having an elongate body portion which has a lower end which has an outer ground engageable shroud which can extend about a golf ball on the ground, a golf ball positioning member located within the outer shroud and which can hold the top and/or sides of the golf ball, and a releasable golf ball gripping means which is at least partially within the shroud and which holds the golf ball against the positioning member, and which can be released to release the golf ball.

The golfing aid provides relief to golfers with arthritic problems, pregnancy, or who find it otherwise difficult to kneel or bend over in order to pick up a golf ball or position a golf ball on a tee, or correctly position the golf tee into the ground.

The elongate body portion is suitably of a length sufficient to allow a person to pick up a golf ball without unnecessary bending. The elongate body portion can be a standard size or various sizes depending on the height of the golfer. The elongate body portion can be formed from telescopic sections or be otherwise height adjustable to suit the various golfers. It is preferred that the elongate body portion is a cylindrical shaft.

The elongate body portion has a lower end which is formed with a golf ball positioning member which can hold the top and/or sides of the golf ball.

In one form, the golf ball positioning member comprises a recess, socket, cup and the like which is dimensioned to overlie the upper portion of the golf ball. It is preferred that the positioning member only holds an upper part of the golf ball but is not able to grip the golf ball sufficiently to allow the golf ball to be lifted from the ground.

The lower end is further associated with a releasable golf ball gripping means which functions to allow the golf ball to be held such that it can be lifted by the golfing aid from the ground. In one form, the golf ball gripping means comprises a plurality of fingers or claws which can be moved between a released position where the golf ball can fall from the golf ball positioning member, and a gripping position where the fingers or claws hold the golf ball against or in association with the positioning member. Of course, it is also envisaged that the golf ball gripping means can hold the golf ball relative to another part of the golfing aid and not necessarily against the golf ball positioning member, it being necessary only that the golf ball can be lifted by the golfing aid in a releasable manner.

The golfing aid can be provided with a releasable golf tee gripping means to enable a tee to be held against the golf ball while the golf ball is being held by the golfing aid.

This will allow a golfer to lift a golf ball from the ground, or place a golf ball into the golfing aid, then place a tee against the golf ball followed by pressing the golf ball and tee combination into the ground after which the releasable golf ball gripping means and the releasable golf tee gripping means can be moved to a released position to enable the golfing aid to be removed.

For design simplicity, it is preferred that the golf ball gripping means and the golf tee gripping means both comprise fingers or claws, and it is preferred that a single gripping means functions to grip the golf ball and a golf tee (this doing away with the requirement for two sets of fingers or claws).

In a further form of the invention, the golfing aid can be provided with a height adjustment means which allows the tee to be inserted into ground surface at various distances.

In one form of the invention, an outer shroud is provided at a lower part of the aid and which can be placed over a golf ball lying on the ground. The shroud assists in placement of the aid over the ball such that the ball can be picked up, The shroud can also form part of the height adjustment means to result in an easy to use golfing aid. The shroud can also assist in ensuring that the golf aid is positioned substantially vertically for inserting a golf ball and tee into the ground.

For ease of use, it is preferred that the golfing aid has an upper handle, and the handle may be associated with an actuator or trigger to move the golf ball and/or the golf tee gripping means between its gripping position and release position.

BRIEF DESCRIPTION OF THE DRAWINGS

An embodiment of the invention will be described with reference to the following drawings in which.

Figure 1:
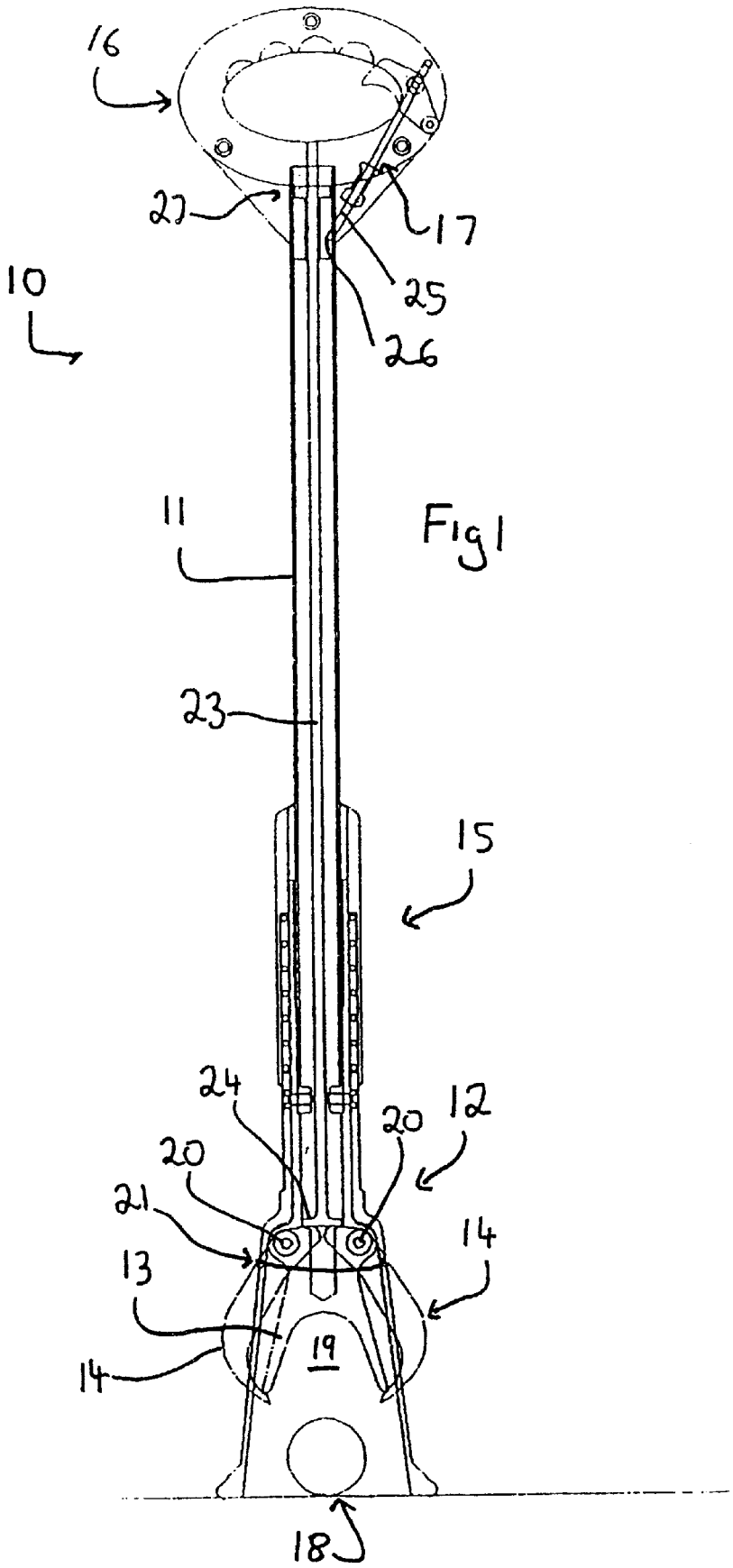
FIG. 1 shows a golfing aid placed over a golf ball and ready to pick up the golf ball.

Referring to the figures and initially to FIG. 1, there is illustrated a golfing aid 10 which can hold a golf ball and tee together for insertion into the ground. Aid 10 has an elongate body portion 11. Body portion 11 in the embodiment is a cylindrical shaft. Body portion 11 has a lower end 12 which has a golf ball positioning member in the form of a inner cup 13, and a releasable golf ball gripping means in the form of opposed claws 14. The golfing aid 10 in the embodiment is further provided with a height adjustment means 15 which will be explained in greater detail below, and an upper handle 16 which is fitted with a trigger arrangement 17 which will also be described in greater detail below.

In FIG. 1, golfing aid 10 has been placed over a golf ball 18 and is ready to pick up the golf ball.

Referring in greater detail to cup 13, this is formed from a plastics or rubber material and has an annular socket 19 which is dimensioned to fit over the top and sides of golf ball 18. Socket 19 functions to position the golf ball but cannot itself lift the golf ball off the ground surface.

For convenience sake, claws 14 are pivotally connected to upper parts of cup 13 through pivot pins 20. In the embodiment, three equally spaced apart claws are provided, but only two are illustrated in FIG. 1. The claws 14 can pivot between an open released position (illustrated in FIG. 1) where ball 18 can move into socket 19, and a closed engaging position (illustrated in FIG. 3) where claws 14 have pivoted towards each other to hold the golf ball inside socket 19.

Figure 2:
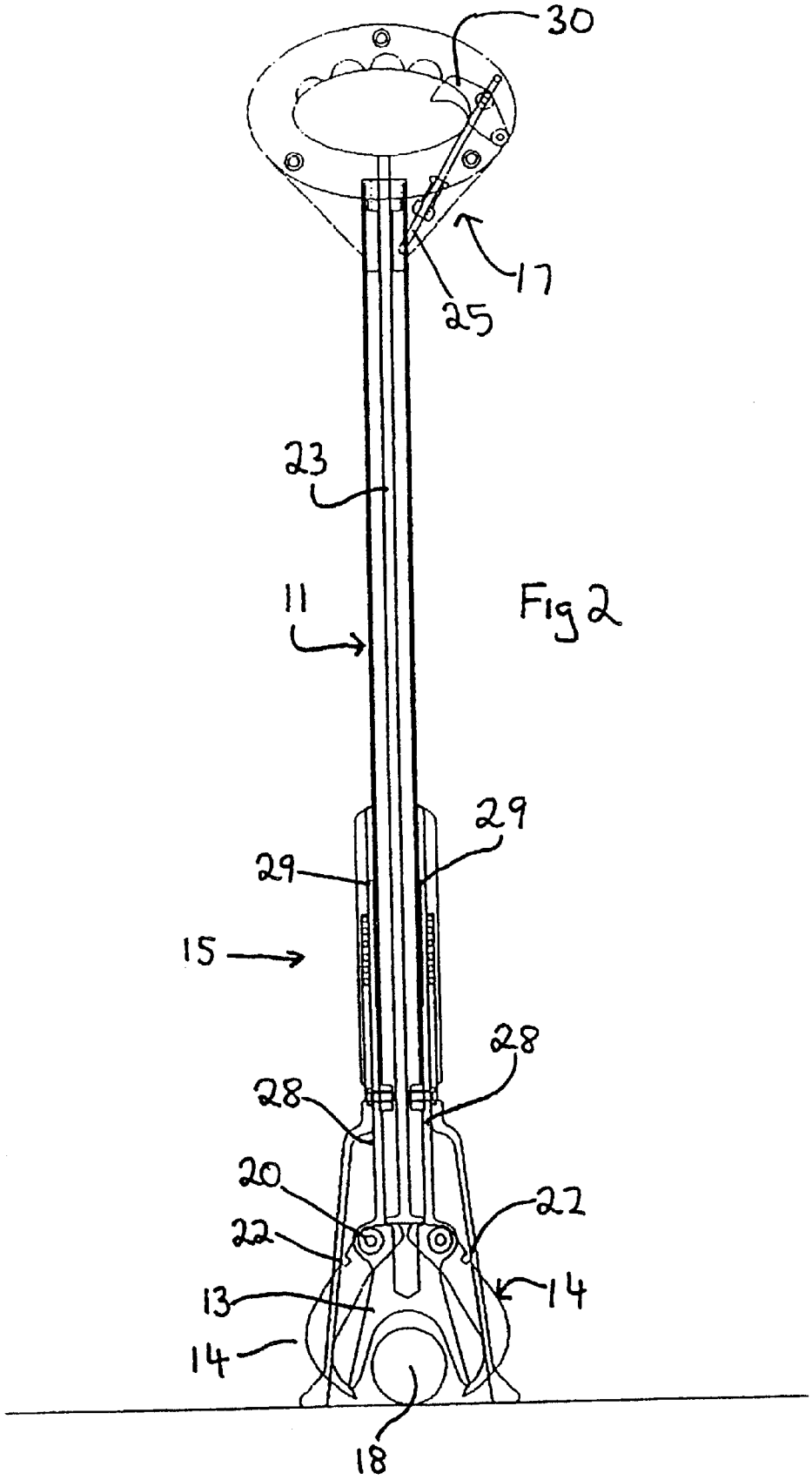
FIG. 2 illustrates the golfing aid of FIG. 1 where the golf ball is about to be scooped up off the ground.

Claws 14 are biased towards the closed engaging position by an elastomeric O-ring 21 which locates within notches in claws 14 (FIG. 2 omits the O-ring 21 to illustrate the notches 22). O-ring 21, by being elastomeric, forces claws 14 towards each other and into the closed engaging position.

Claws 14 can be pushed against the bias of O-ring 21 into their open position by an internal push rod 23 which extends through the inside of elongate body portion 11. The bottom of push rod 23 is provided with a head 24 which abuts against the upper parts of claws 14 such that when push rod 23 pushes downwardly, claws 14 are forced open against the bias of O-ring 21, while when push rod 23 is relaxed, the elastomeric properties of O-ring 21 is sufficient to force claws 14 back to their closed position.

Figure 3:
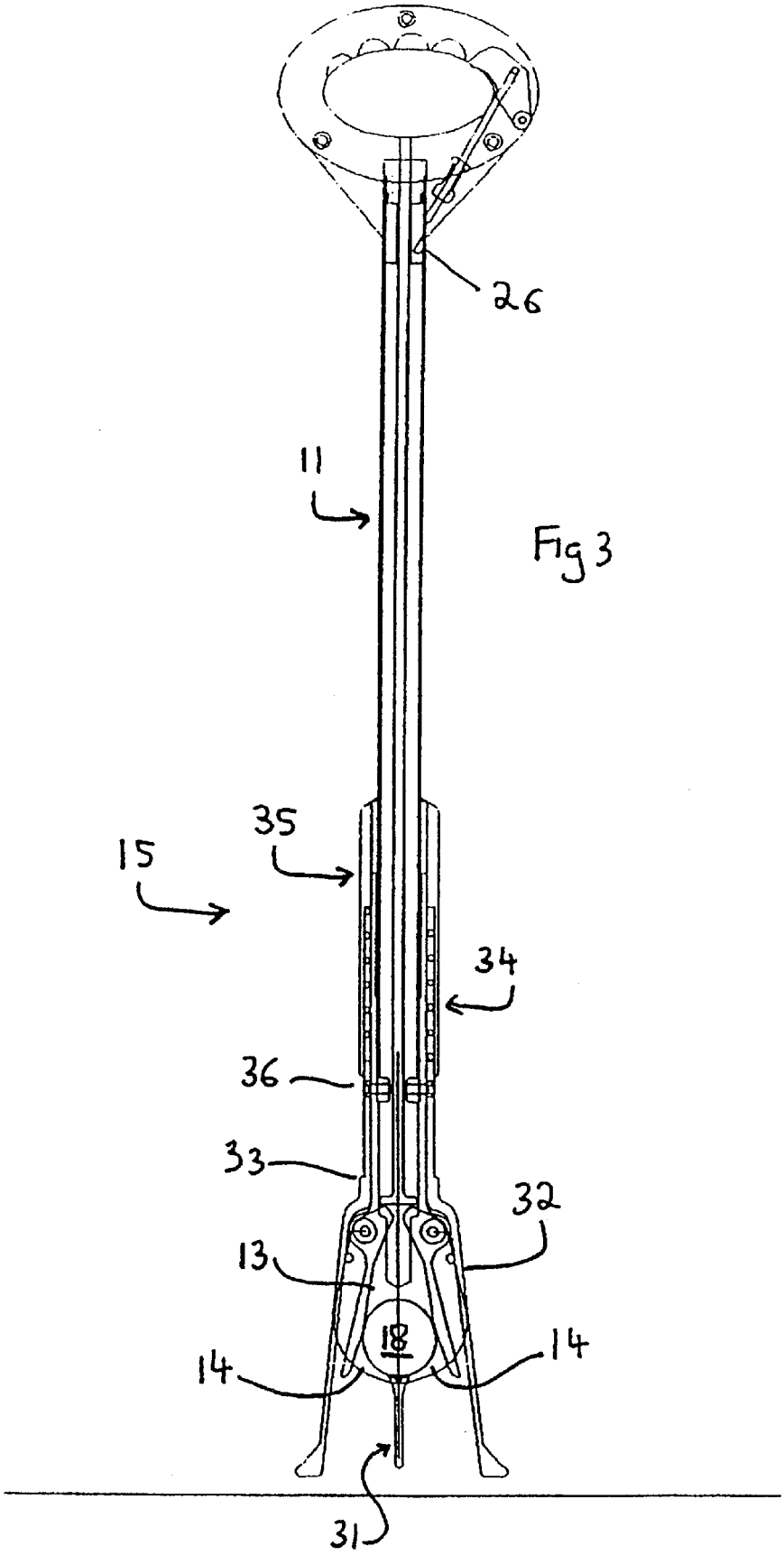
FIG. 3 shows the golfing aid where the golf ball has been picked up off the ground and a golf tee has been inserted and secured against the golf ball.

Push rod 23 is maintained in its downward claw opening position by trigger arrangement 17 which has a trigger pin 25 which locates inside a socket 26 on body portion 11 (socket 26 being better illustrated in FIG. 3).

The operation of the golfing aid will now be described.

Initially, and referring to FIG. 1, golfing aid 10 is placed over golf ball 18 with claws 14 in the open released position. Claws 14 are held in the open released position by push rod 23 being pushed downwardly (there being an upper spring 27 to bias push rod 23 downwardly), with trigger pin 25 being located in socket 26 to hold claws 14 in the open position.

Referring now to FIG. 2, the cup 13 and claws 14 have been pushed down over the top of golf ball 18 with the claws still in the retracted position such that golf ball 18 can move into socket 19 in cup 13.

Referring to FIG. 2, it can be seen that claws 14 are pivotally attached to cup 13 through pivot pins 20 and the upper portion of cup 13 is attached to a sliding tube member 28 which slides over the lower end of body portion 11. Sliding tube member 28 has an upper end 29 which is situated within the height adjusting means 15. The lower end of body portion 11 is fixed to sliding tube member 28 such that the body portion 11 can be pushed downwardly which will push sliding tube member 28 downwardly such that cup 13 and claws 14 are pushed over and around golf ball 18.

Once golf ball 18 is inside cup 13, trigger 30 is depressed to pull back pin 25 which in turn releases push rod 23 allowing it to be retracted upwardly which closes claws 14 about the bottom of golf ball 18.

FIG. 3 illustrates this arrangement where claws 14 are now closed and trap golf ball 18 inside cup 13. At this position, the golfing aid can be turned around such that a tee 31 can be inserted between claws 14 by manually prising claws 14 open to a sufficient amount to allow tee 31 to be inserted (it being appreciated that the claws are biased by O-ring 21 and therefore not difficult to prise apart sufficiently to allow tee 31 to be inserted). When the tee has been inserted, the golfing aid now holds golf ball 18 and tee 31 together. The golfing aid can be placed on the back of a golf cart or golf buggy pre-loaded with golf ball and tee.

Figure 4:
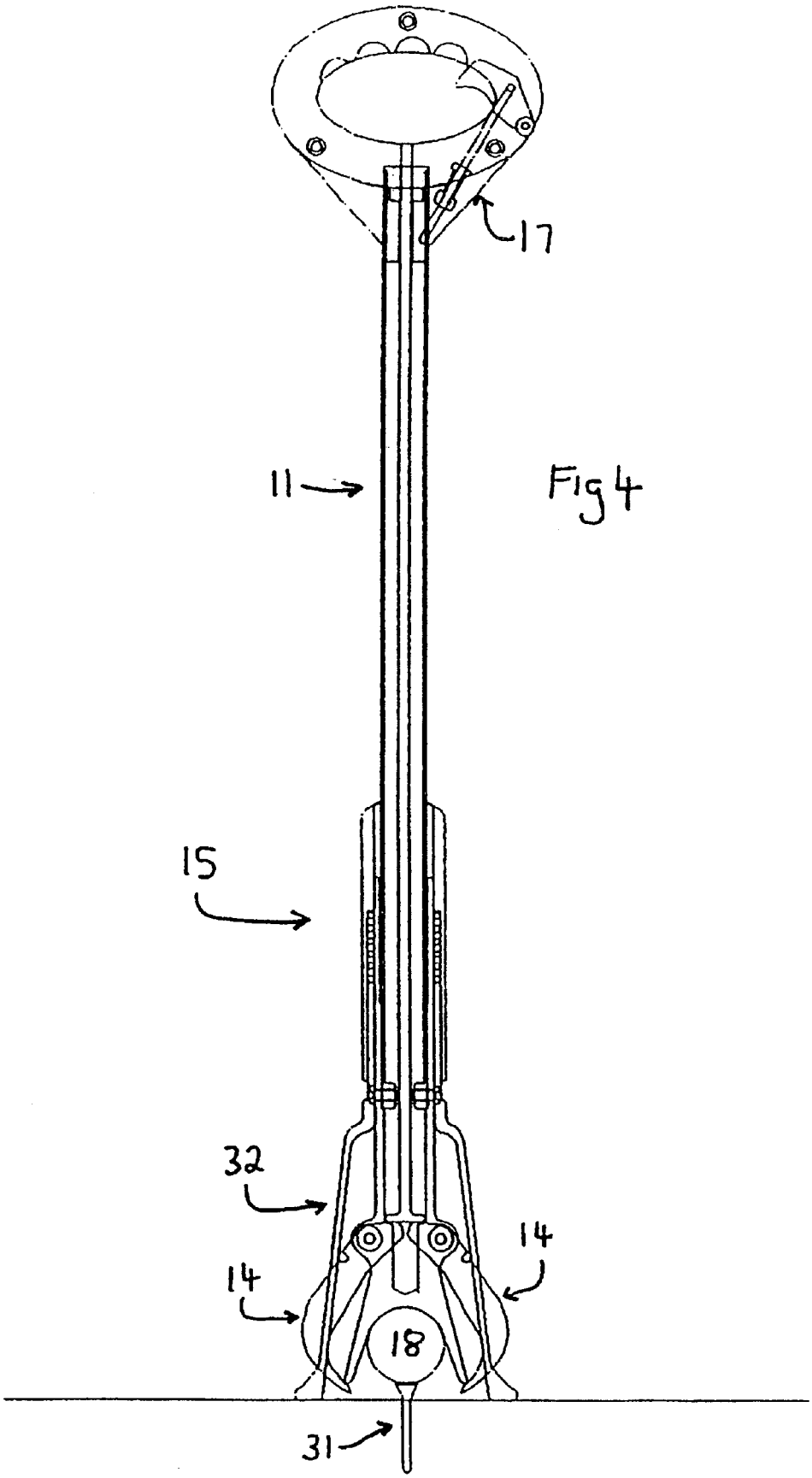
FIG. 4 illustrates the golfing aid where the tee and golf ball have been placed in the ground.

FIG. 4 shows the golfing aid pressing golf ball 18 and tee 31 into the ground. This is achieved by pushing down on body portion 11 and releasing claws 14.

In FIGS. 3 and 4, the functioning of the height adjustment means 15 is illustrated. The height adjusting means includes an outer support or shroud 32 which has an upper annular shoulder 33. Height adjusting means 15 has an internal spring 34 and an outer sleeve 35. Sleeve 35 can have a pin and slot arrangement such that it can be pinned to body portion 11 at different positions each position varying the distance that tee 31 is pressed into the ground. This arrangement allows the golf ball and tee to be set at a number of preset heights out of the ground depending on the type of iron or wood which will be used to tee-off.

Pushing down body portion 11 will cause cup 13 to push golf ball 18 and tee 31 into the ground but only until the lower part 36 of sleeve 35 abuts against shoulder 33 (this distance being determined by where sleeve 35 is attached to body portion 11). Once the abutment occurs, body portion 11 can be depressed no further and claws 14 can be caused to spring open to release the golf ball and tee.

Figure 5:
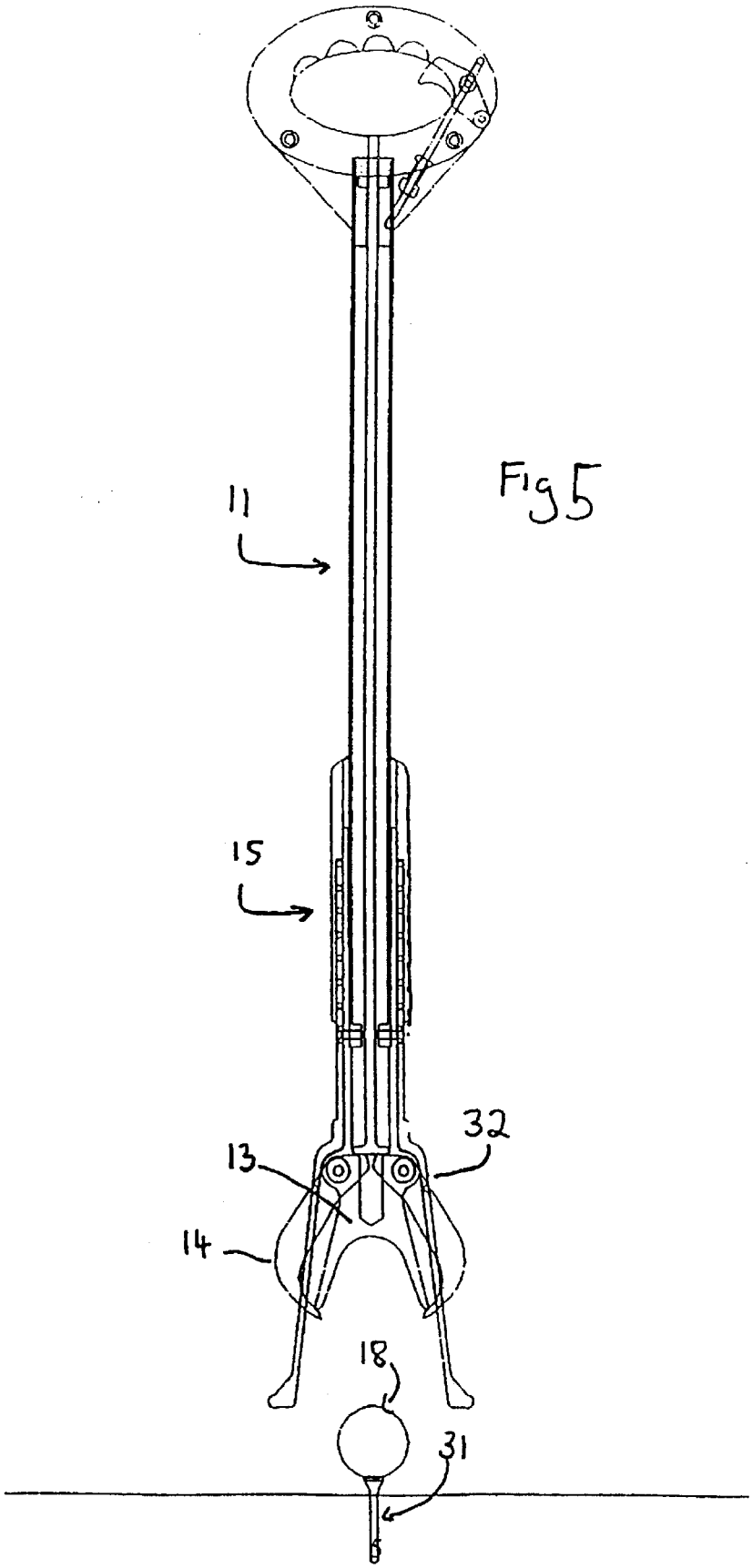
FIG. 5 illustrates the golfing aid pulled away from the golf ball and tee and ready for re-use.

FIG. 5 shows the arrangement where the golf ball and tee have been placed into the ground and the golfing aid has been lifted away from the arrangement.

It should be appreciated that various other changes and modifications can be made to the embodiment described without departing from the spirit and scope of the invention.

What is claimed is:

1. A golfing aid which can pick up a golf ball from the ground and/or position a golf ball relative to the ground, the golfing aid having an elongate body portion which has a lower end which has an outer ground engageable shroud which can extend about a golf ball on the ground, a golf ball positioning member comprising a cup located within the outer shroud and which can hold the top and/or sides of the golf ball, a releasable golf ball gripping means which is at least partially within the shroud and which holds the golf ball against the positioning member and which can be released to release the golf ball the golf ball gripping means comprising a plurality of claws which are pivotally attached to the cup, and which can pivot between an open position where the golf ball can pass between the claws and into the cup, and a closed position where the claws retain the golf ball against the cup and a releasable golf tee gripping means which holds the golf ball and tee together.

2. The golfing aid of claim 1, wherein the claws are biased into the closed position.

3. The aid of claim 2, including a sliding tube member which is slidable along the elongate body portion, the claws and the cup being attached to the lower part of the sliding tube member, and biasing means to bias the tube member away from the ground.

4. The aid of claim 3, wherein the elongate body portion has an upper end which has a hand grippable handle, a push rod extending from the upper end and having a lower end which abuts against the claws, the push rod being reciprocal between extended position where the push rod forces the claws to an open position, and a retracted position, biasing means to bias the push rod into its retracted position, and a trigger mechanism which holds the push rod against its biasing means in the extended claw opening position, the trigger mechanism being releasable to shoot the push rod into its retracted position which allows the claws to move to their closed position.

5. The aid of claim 4, wherein the golf tee gripping means is the claws.

6. The aid of claim 3, wherein the biasing means is a spring positioned between the outer sleeve, and the sliding tube member.

7. The aid of claim 1 comprising a height adjustment means to allow the golf ball and tee to be set at a number of preset heights out of the ground, the height adjustment means comprising the ground engageable shroud which has an upper annular shoulder, an outer sleeve which extends about the elongate body portion, a helical spring which is positioned between the outer elongate body and the outer sleeve, and means to releasably attach the outer sleeve relative to the body portion at different positions, each said position varying the distance that the tee is pressed into the ground.

8. The aid of claim 7, wherein the means to releasably attach the outer sleeve relative to the body portion comprises a pin and slot arrangement.

* * * * *